US006649817B2

(12) United States Patent
Hartill

(10) Patent No.: US 6,649,817 B2
(45) Date of Patent: Nov. 18, 2003

(54) INTERCHANGEABLE DECORATIVE APPLIQUE

(75) Inventor: William T. Hartill, Portage, MI (US)

(73) Assignee: Riff-Master Guitar Products, LLC, Portage, MI (US)

( * ) Notice: Subject to any disclaimer, the term of this patent is extended or adjusted under 35 U.S.C. 154(b) by 72 days.

(21) Appl. No.: 10/078,899

(22) Filed: Feb. 19, 2002

(65) Prior Publication Data

US 2002/0152659 A1 Oct. 24, 2002

Related U.S. Application Data

(60) Provisional application No. 60/270,751, filed on Feb. 22, 2001.

(51) Int. Cl.[7] ..... G10D 1/08
(52) U.S. Cl. ..... 84/267
(58) Field of Search ..... 84/267, 290, 291, 84/289

(56) References Cited

U.S. PATENT DOCUMENTS 6,352,654 B1 * 3/2002 Silvi et al. ..... 252/511

* cited by examiner

*Primary Examiner*—Kimberly Lockett
(74) *Attorney, Agent, or Firm*—Robert Kelley Roth; Miller, Canfield, Paddock & Stone, PLC

(57) ABSTRACT

An interchangeable decorative applique is disclosed which can be used on a pickguard for a stringed instrument or other surface and comprises a base adapted to be affixed to the surface and a removable applique that overlies the base. The applique is attached to the base by a removable fasteners that permits the applique to be removed and replaced. The applique can have a replaceable decorative section that is sandwiched between the base and a light permeable protective cover.

6 Claims, 13 Drawing Sheets

INTERCHANGEABLE DECORATIVE APPLIQUE

CROSS-REFERENCES TO RELATED APPLICATION

This utility patent application claims priority to U.S. Provisional Patent Application No. 60/270,751, filed Feb. 22, 2001.

FIELD OF THE INVENTION

This invention relates to decorative appliques, and more particularly, to decorative appliques such as pickguard systems with interchangeable skin for use with stringed instruments.

BACKGROUND OF THE INVENTION

Decorative appliques have a wide variety of usages. One common use is as part of a pickguard used with musical instruments, notably the guitar. The pickguard is used on guitars in order to prevent damage to the face or surface of the guitar when the strings are played with a pick. A pickguard typically is made of a plastic resin in a desired perimetric shape and mounted by screws or the like. When applied to the face of the body of an electric guitar, the pickguard often is applied to the guitar with certain components, such as the electrical pickups which are mounted to the underside of the pickguard.

Pickguards typically are produced with one particular surface appearance and that appearance remains with the instrument as long as the pickguard is used. Pickguard replacement is generally time consuming and troublesome and not undertaken, particularly when the electronics and pickups have to be removed and reinstalled on the new pickguard. It would be desirable to provide a pickguard that can remain permanently affixed to a guitar yet employ a removable decorative applique, such that the appearance of the guitar can be changed at will by simply replacing the applique on the pickguard.

SUMMARY OF THE INVENTION

In accordance with a first aspect, an interchangeable decorative applique comprises a decorative section having a selected surface appearance, the decorative section being shaped to at least partially cover a mounting surface of a base of an item such as a musical instrument, a clear protective sheet shaped to overlie the decorative section, and fasteners for removably fastening the protective sheet over the base such that the decorative section is adapted to be sandwiched between the base and the protective sheet and permitting the protective sheet and underlying decorative sheet to be removed without removing the base.

From the foregoing disclosure and the following more detailed description of various preferred embodiments it will be apparent to those skilled in the art that the present invention provides a significant advance in the technology and art of computer security systems. Particularly significant in this regard is the potential the invention affords for providing a high quality, low cost, readily interchangeable decorative appliques. Additional features and advantages of various preferred embodiments will be better understood in view of the detailed description provided below.

Figure 1:
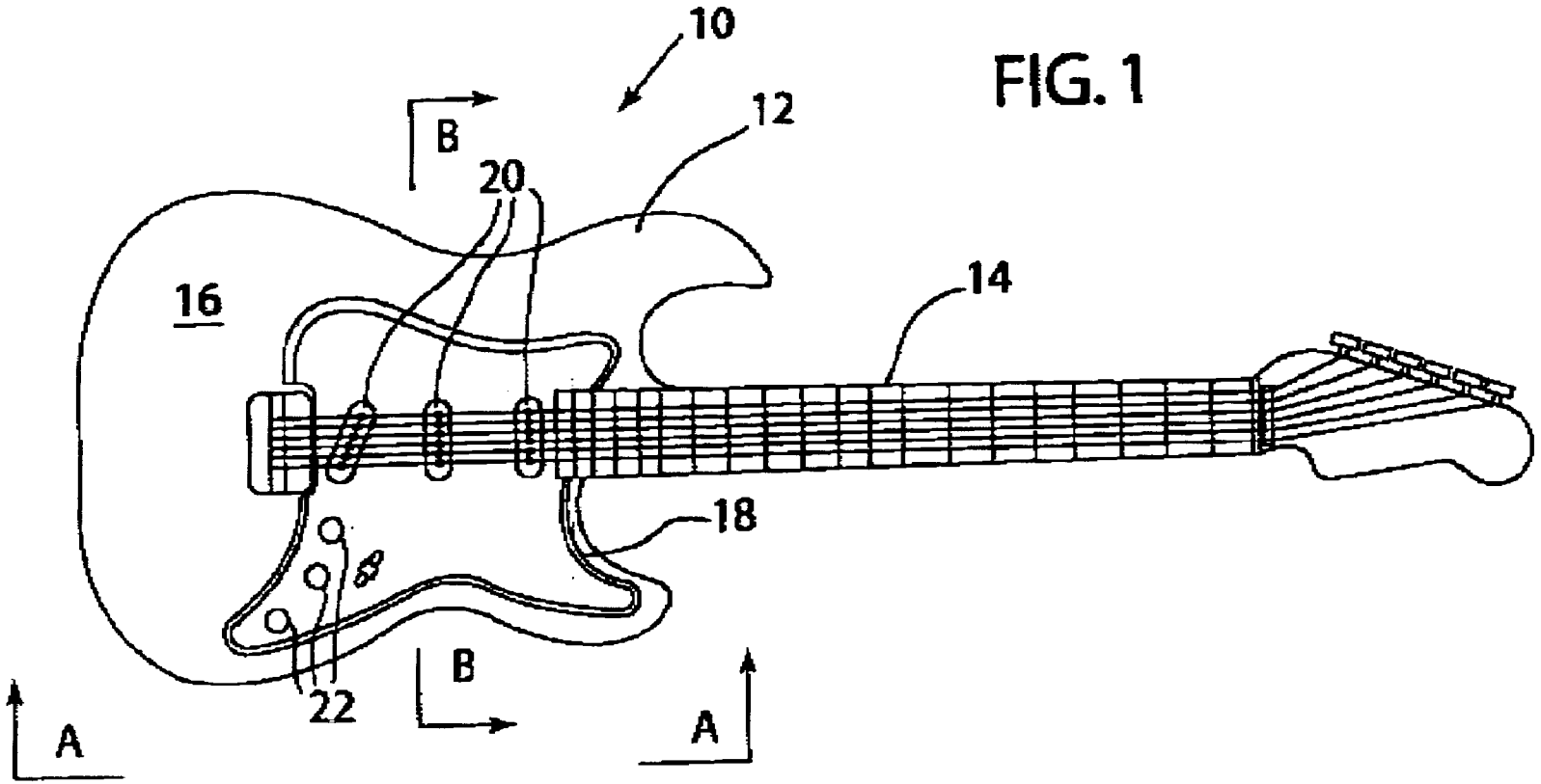
FIG. 1 is a plan view of a musical instrument (an electric guitar) showing a pickguard in accordance with a preferred embodiment of the present invention.

It should be understood that the appended drawings are not necessarily to scale, presenting a somewhat simplified representation of various preferred features illustrative of the basic principles of the invention. The specific design features of the interchangeable decorative applique as disclosed here, including, for example, the specific fastening device will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the interchangeable decorative applique disclosed here. The following detailed discussion of various alternative and preferred features and embodiments will illustrate the general principles of the invention with reference to an interchangeable skin suitable for use with a guitar. Other embodiments suitable for other applications such as interchangeable decorative appliques for cell phones, will be apparent to those skilled in the art given the benefit of this disclosure.

Referring now to the drawings, FIG. 1 shows a musical instrument 10 in the form of a solid body electrical guitar has a body 12 and a neck 14. A face 16 of the guitar body has a pickguard 18 of the present invention. The face can also comprise certain surface mounted components, such as electrical pickups 20 and electrical control knobs 22 for controlling electrical output such as tone and volume.

In a conventional electrical guitar, the pickguard is attached to the face of the guitar by eight to eleven visible screws, and the electrical pickups are mounted to the underside of the pickguard. The electric controls are generally mounted in recesses in the surface of the guitar under the pickguard. The controls have stems that fit through openings in the pickguard, and knobs fit on the stems on the outside surface of the pickguard.

Replacement of a conventional pickguard requires removal of the electrical pickups and repositioning and replacement of the pickups on a new pickguard, in addition to releasing the screws and replacing the pickguard itself. This is sufficiently tedious that frequent replacement of pickguards is not a common occurrence.

In the present invention, the decorative appearance of the outer surface of the pickguard can be changed easily without changing the pickguard itself or removing the electrical componentry. Several ways of doing this are disclosed. In all aspects of the invention, a base 24 is attached to the face of the guitar and a removable skin (which may comprise one or more sheets of material) is mounted on the base.

Figure 2:
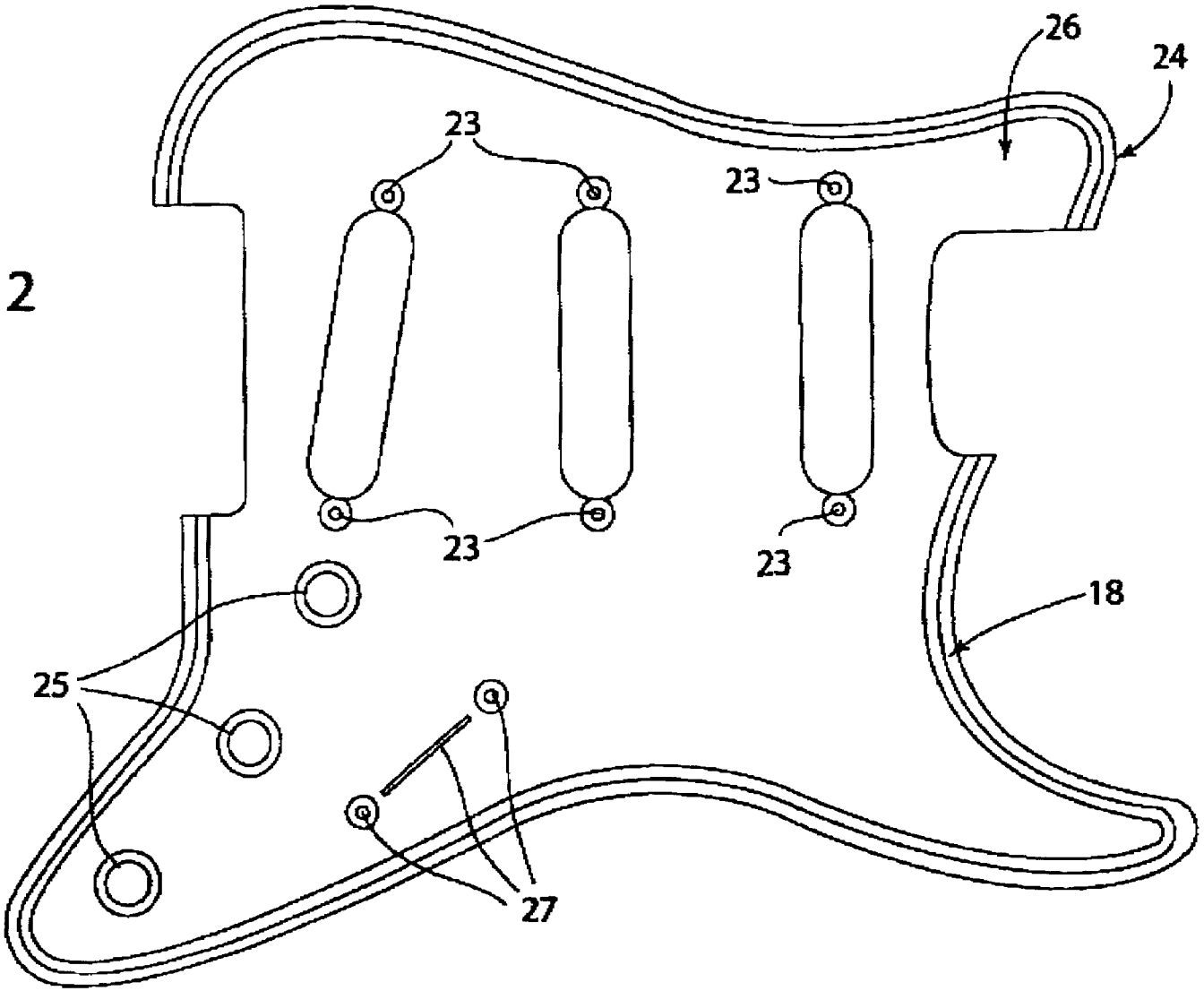
FIG. 2 is a plan view of the pickguard of FIG. 1.
Figure 3:
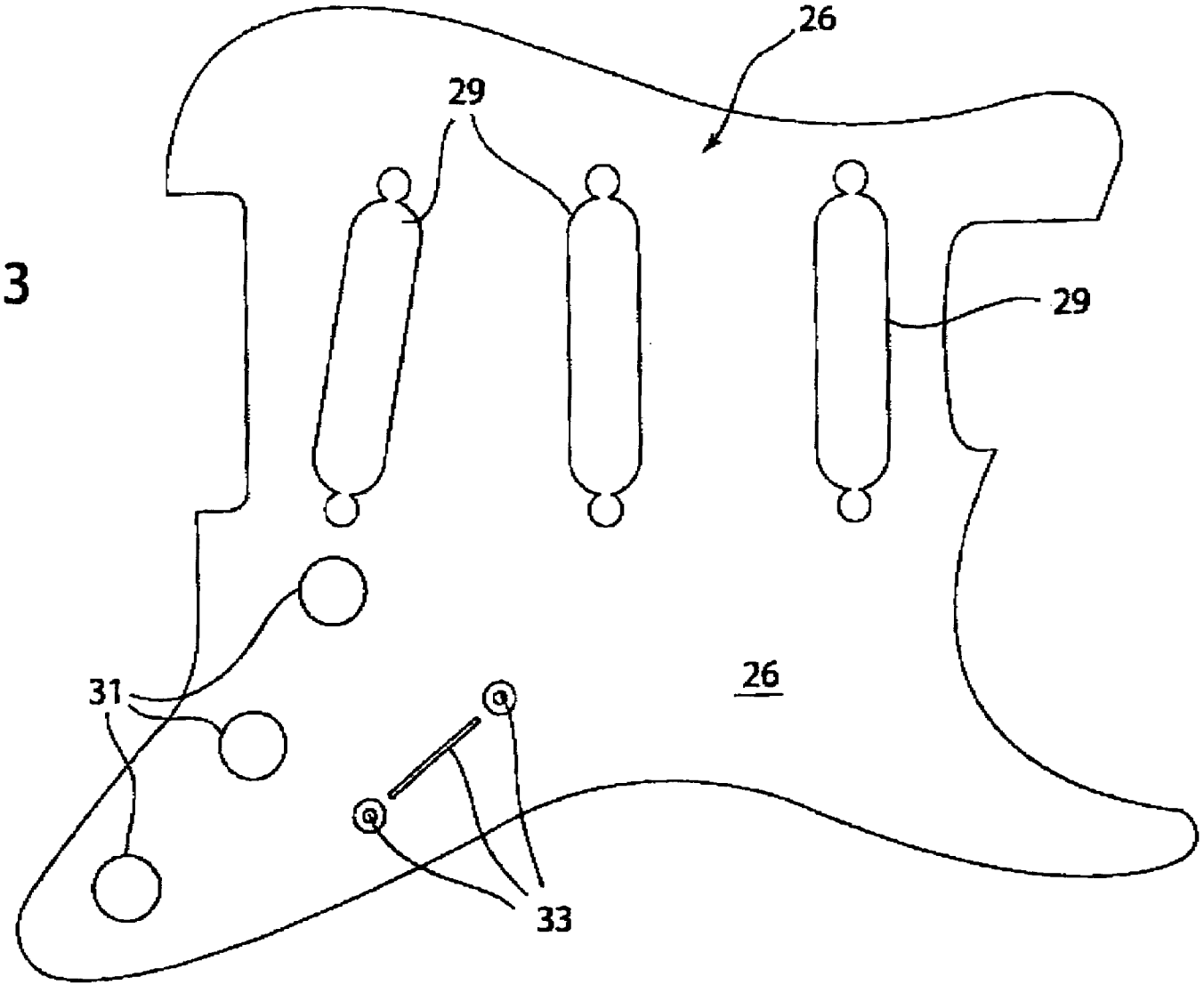
FIG. 3 is a plan view of the applique employed in the pickguard of FIGS. 1 and 2.

A changeable decorative appearance is achieved by attaching a removable decorative applique or skin 26 (FIG. 3) on top of the base. The decorative skin can be a single sheet of material or it can be a decorative sheet or section of printed material covered by a light transmitting cover sheet, as shown in the several embodiments illustrated herein. In any case, as shown in FIG. 3, the skin includes openings 29 for pickups and openings 31 and 33 for other electrical controls. The base typically is mounted under the pickups and has openings 23 for pickup fasteners and openings 25 and 27 for controls (see FIG. 2). The base could have openings that fit over the pickups.

In a first embodiment of the present invention, pickguard 31 has a base 30 that is mounted on the face 16 of guitar body 12 by conventional threaded fasteners or screws 32. The fasteners are received in countersunk holes in the base that are positioned to be aligned with any preexisting pickguard fastener holes in the face of the guitar. Since the base is not intended to be removable, pickups 20 may be mounted on the underside of the base before it has been mounted on the guitar by means of fastener holes 23 (FIG. 2). Alternatively, the base can be provided with openings that permit the pickups to be mounted on the face of the guitar, with the base fitting over the pickups. In any case, the pickups are mounted so that they are appropriately spaced from strings 34. The base can have any desired shape or perimetric configuration. The configuration of FIG. 1 is exemplary. The base may be formed of any suitable material, such as a sheet plastic material that is one-sixteenth inch thick or more.

A changeable decorative appearance of the pickguard is provided by sandwiching a removable decorative sheet or section 36 between the base and an outer protective sheet 38 that is sufficiently translucent to light that a desired appearance of the decorative sheet or section can be seen through the protective sheet. Typically, the protective sheet is a clear acrylic sheet material about one-sixteenth inch thick, and may have rounded edges 40. Various other visual effects can be incorporated into the protective sheet, however, in order to complement the appearance of the decorative sheet. Also, the decorative sheet or section can be incorporated into the protective sheet, dispensing with the need for a separate decorative sheet and making the appearance of the pickguard interchangeable by replacing the protective sheet. Providing a separate relatively inexpensive decorative sheet formed of an easily printable material can provide cost advantages over the necessity of replacing a protective sheet for every design desired.

Figure 4:
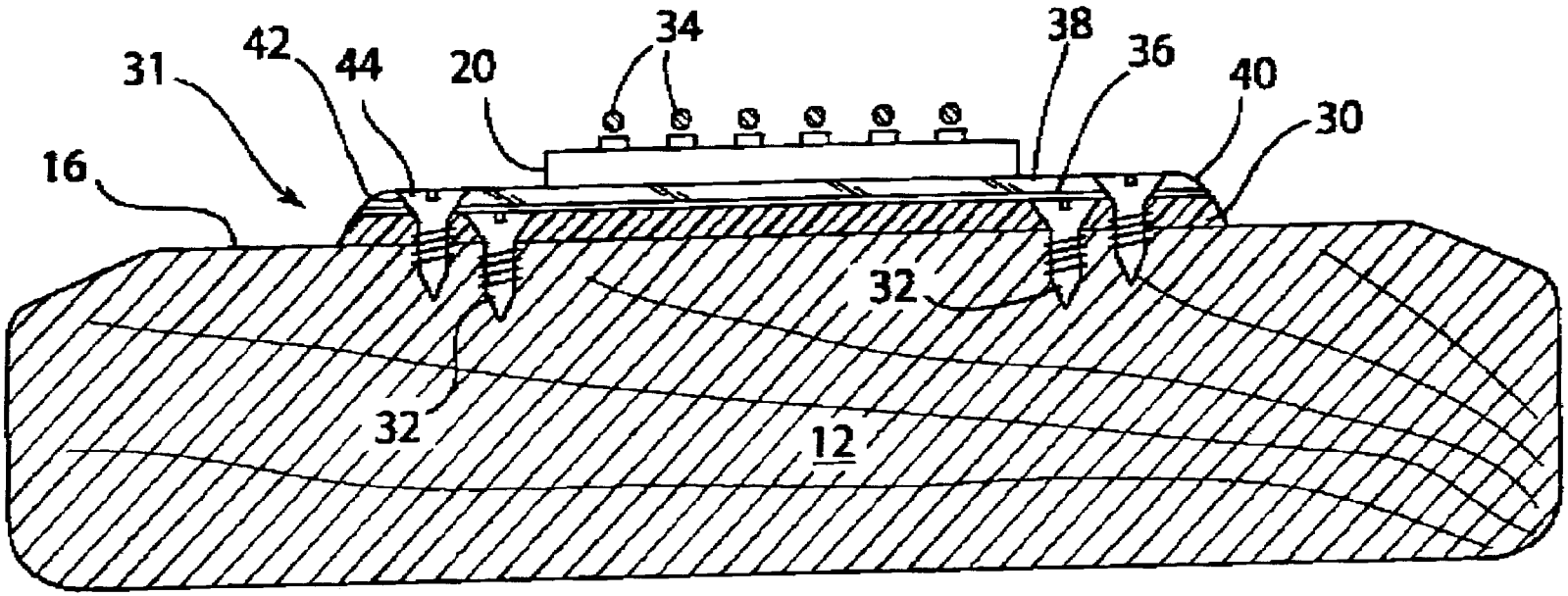
FIG. 4 is a cross-sectional view taken along lines B—B of FIG. 1, showing a first embodiment of the pickguard of the present invention.

In the embodiment of FIG. 4, decorative sheet 36 is formed of paper or other printable material. Since the decorative sheet is sandwiched between two plastic layers, the decorative sheet does not have to resist abrasion or provide structural support.

The protective sheet 38 has a plurality of countersunk holes 42 around the perimeter, such that screws 44 or other threaded fasteners can be inserted through the protective sheet and through the base sheet into the body of the guitar. The openings are aligned with pre-existing openings in the face of the guitar for a conventional pickguard. Desirably, in a guitar having a conventional pickguard held in place by eleven screws, the base of the present pickguard will have screw openings aligned with seven of the existing screw openings and the protective sheet will have screw openings aligned with the remaining four of the existing screw openings in the guitar.

With the pickguard of FIG. 1, the decorative appearance of the pickguard can be changed simply by removing screws 44, lifting the protective sheet 38 up, removing and replacing decorative sheet 36 with a decorative sheet having a different design or pattern or color and then reaffixing the protective sheet to the base sheet.

While a three layer pickguard is desired, in that it makes it possible to print a virtually unlimited number of inexpensive decorative sheets having different designs and patterns and simply replacing these sheets at will, an interchangeable skin appearance can be provided in a number of alternative ways.

Figure 5:
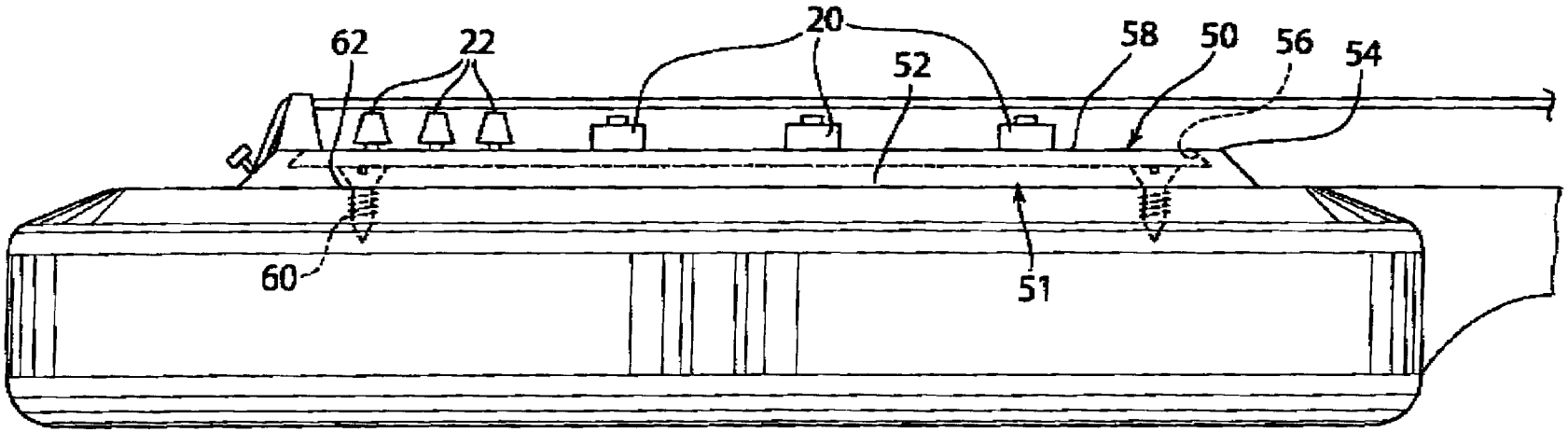
FIG. 5 is a side elevational view of the guitar of FIG. 1, showing a second embodiment of the pickguard of the present invention.
Figure 6:
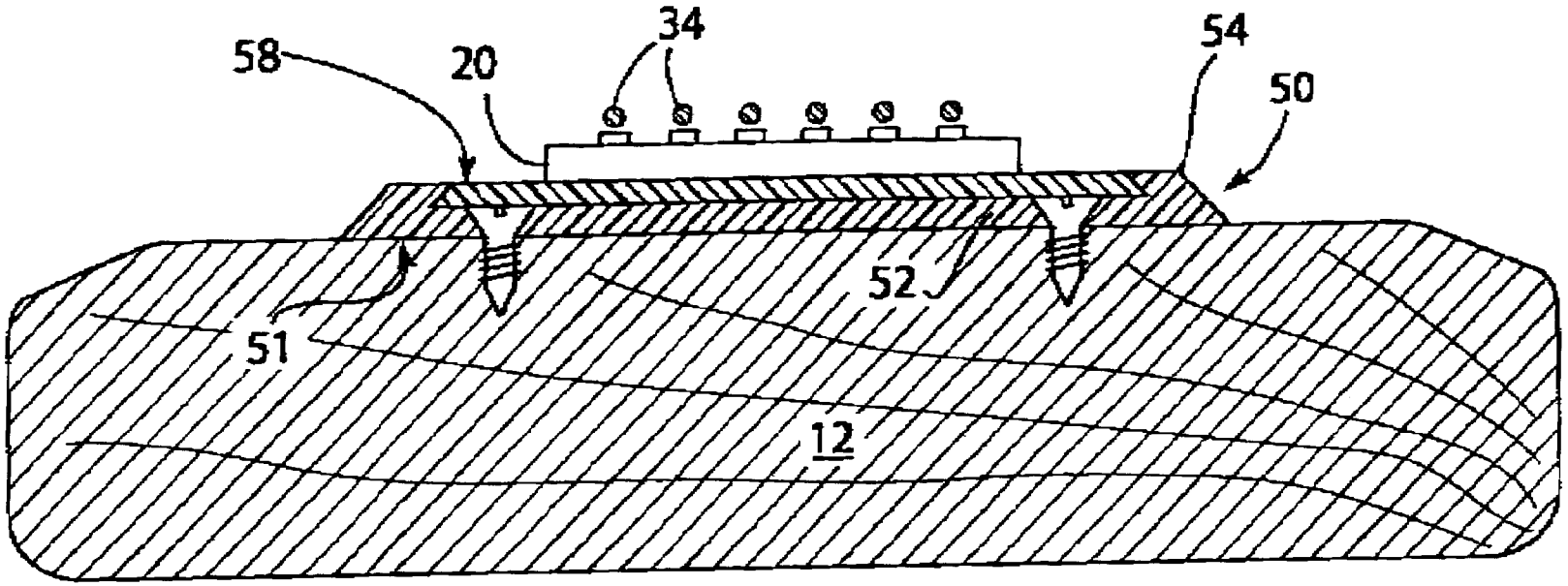
FIG. 6 is a cross-sectional view taken along lines B—B of FIG. 1, showing the second embodiment of the present invention.

In FIGS. 5 and 6, for example, pickguard 50 comprises a base 51 having a flat mounted surface 52 that extends over the surface of the pickguard, with a raised and inwardly inclined rim 54 extending around the perimeter of the base. Rim 54 provides an inwardly beveled interior surface 56. A replaceable skin or top layer 58 fits on top of base mounting surface 52 and has upwardly and inwardly beveled side edges that snap tightly into beveled edges 56 in the base. With the snap fit at the perimeter, the skin is held snugly in the base. As with the previous embodiments, the pickups can be secured to the base, but the removable skin is provided with openings that fit over the pickups so that they do not have to be removed in order to replace the skin.

In the embodiment of FIG. 5, the base is attached to the surface of the guitar by screws 60 that are mounted in countersunk holes 62 in the base. With this embodiment, the skin completely covers and conceals the screws, so the means by which the pickguard is attached to the guitar are completely concealed.

With the pickguard construction of FIG. 5, the skin is desirably a transparent polycarbonate or acrylic material approximately one-sixteenth inch thick. This makes it possible to bend the material sufficient to snap the skin into a fitting relationship with the base.

Figure 7:
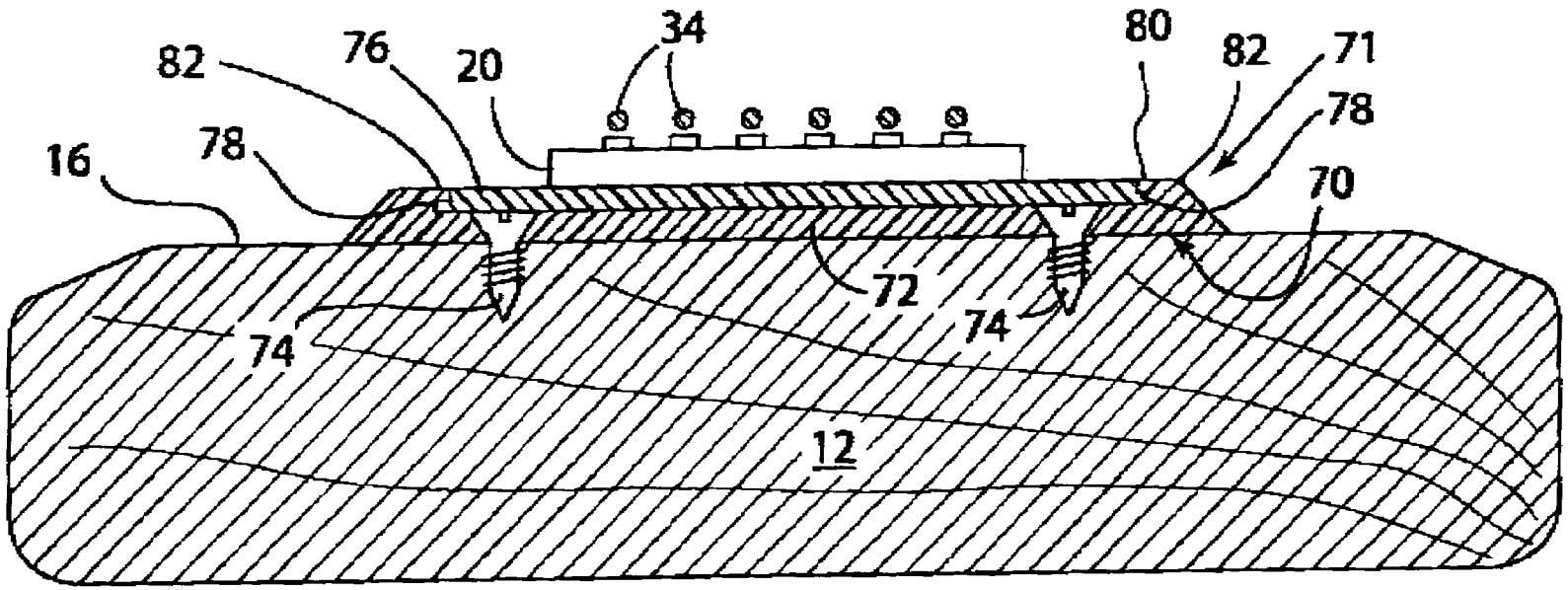
FIG. 7 is a cross-sectional view taken along lines B—B of FIG. 1 showing a third embodiment of the present invention.

Another method for attaching a replaceable skin to a base is shown in FIG. 7. In this embodiment, base 70 of pickguard 71 has a flat mounting surface 72 that is screwed by screws 74 to the body 12 of the guitar. An interchangeable skin 76 is attached to the base by means of an outwardly extending L-shaped flange 78 that fits under an inwardly extending lip 80 in a raised perimetric rim 82 that extends above the mounting surface 72 of the base. The remaining features of this embodiment are the same as previous embodiments.

Figure 8:
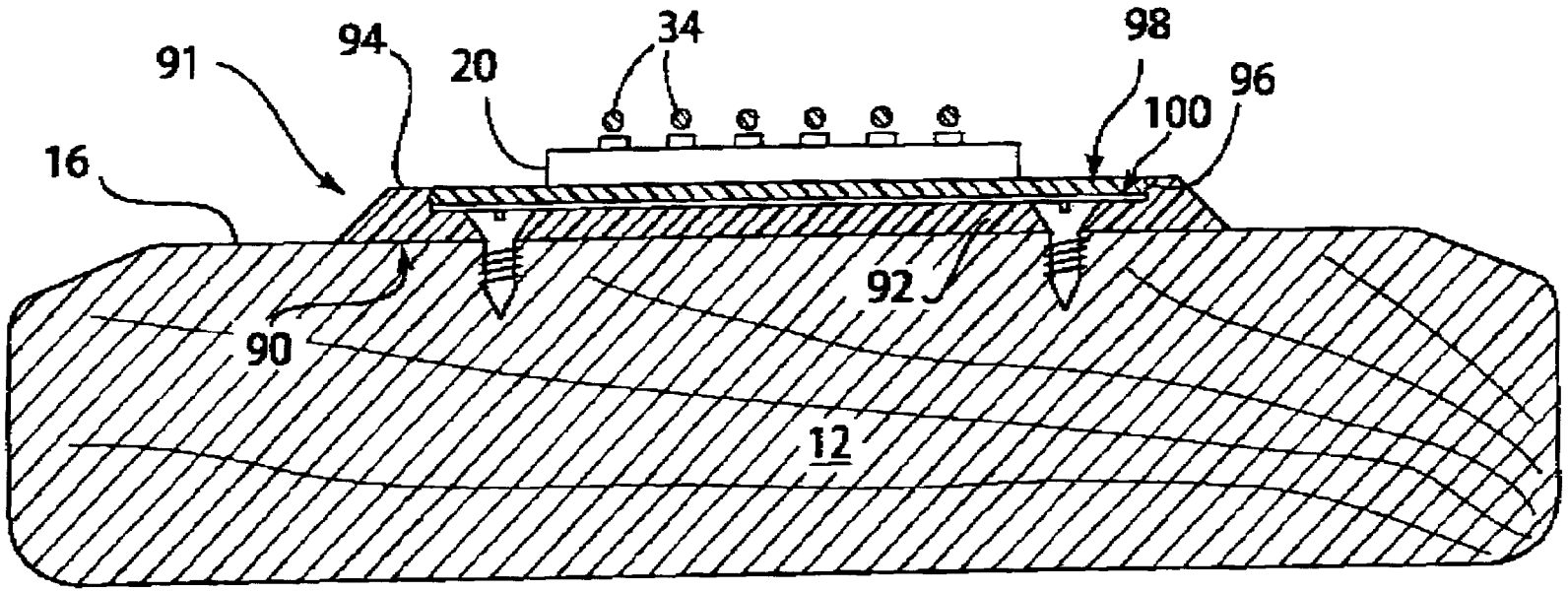
FIG. 8 is a cross-sectional view taken along lines B—B of FIG. 1 showing a fourth embodiment of the present invention.

As shown in FIG. 8, an alternative pickguard 91 can employ a base 90 having a mounting surface 92 with a raised perimetric rim 94. The rim has a substantially vertical inner edge 96. A replaceable surface layer or skin 98 also has a straight vertical perimetric edge that fits inside the rim around the base. The skin is held to the base in this case by a double sided adhesive tape 100 applied around the outer edge or at various locations on the base. Alternatively, the skin could be formed of a contact-type of paper that is printed on one side and includes a pressure sensitive adhesive coating on the other side.

One manner in which a base may be formed with a raised rim around the base is to apply the rim to the base as a separate sheet. The mounting surface of the base can be an acrylic plastic sheet one-sixteenth inch thick or so. The rim can be another sheet of plastic with the center portion removed, so as to leave a rim portion. The rim can be shaped or beveled as desired. The rim portion can then be bonded to the surface layer so as to provide a base having a raised rim.

Figure 9:
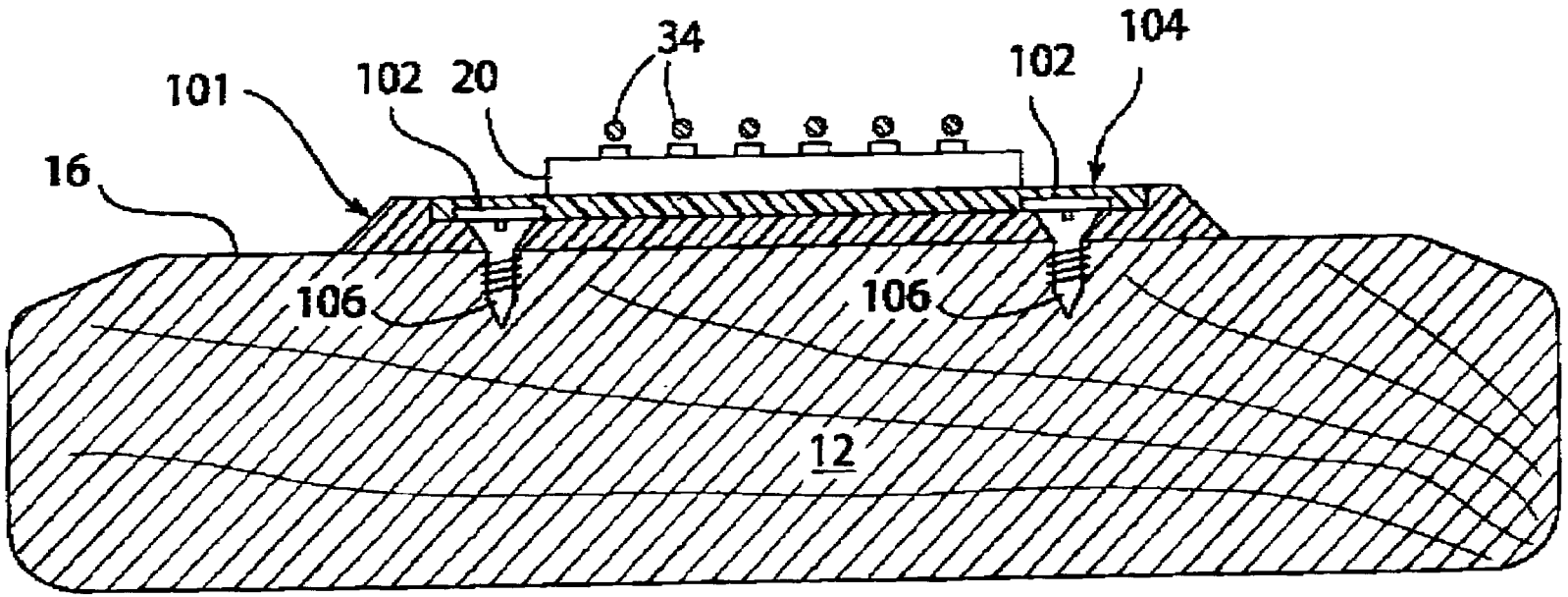
FIG. 9 is a cross-sectional view taken along lines B—B of FIG. 1 showing a fifth embodiment of the present invention.

The pickguard 101 of FIG. 9 is substantially the same as pickguard 91 of FIG. 5, with the exception that magnets 102 are embedded in the underside of interchangeable skin 104. These magnets are spaced so as to be aligned with mounting screws 106 that fasten base 108 to the body 12 of the guitar, with the magnetic attraction between the magnets and the screws holding the skin in place on the base. The magnets can be attached to the skin by an adhesive or epoxy or other attachment means.

Figure 10:
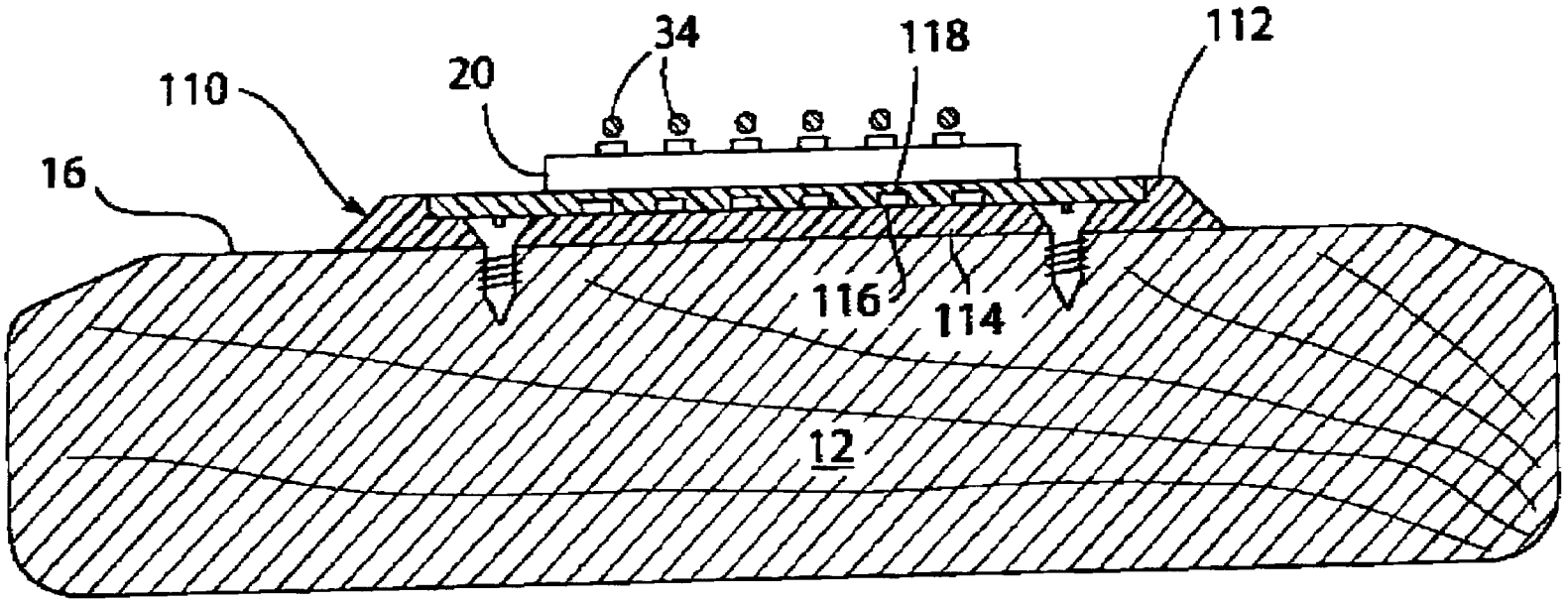
FIG. 10 is a cross-sectional view taken along lines B—B of FIG. 1 showing a sixth embodiment of the present invention.

Another alternative embodiment 110 of the invention, shown in FIG. 10, is substantially the same as the embodiments of FIGS. 8 and 9, with the exception that the interchangeable skin 112 is attached to a mounting surface of a base 114 by means of integral posts 116 that are formed in the base and which mate with integral recesses 118 in the skin (or vice versa). A friction fit between the posts and the recesses causes the skin to be attached to the base.

Figure 11:
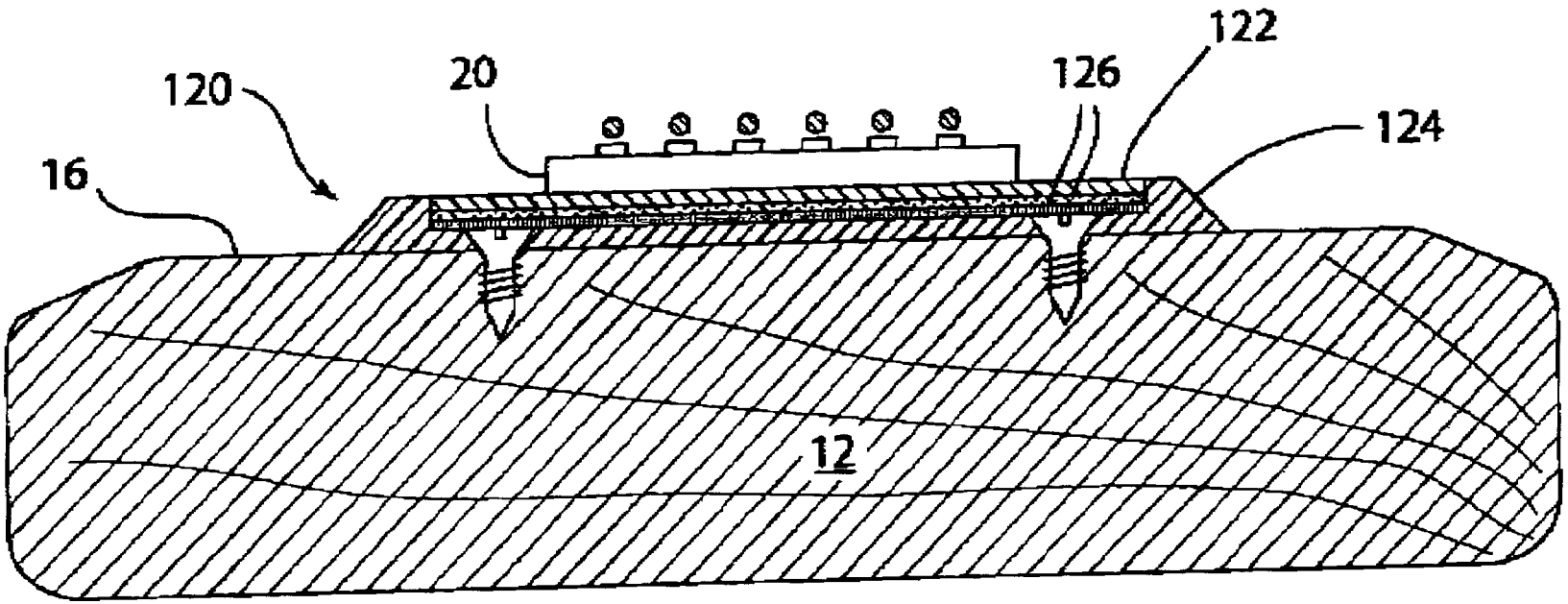
FIG. 11 is a cross-sectional view taken along lines B—B of FIG. 1 showing a seventh embodiment of the present invention.

In the embodiment of FIG. 11, pickguard 120 includes a skin 122 that is attached to a base 124 by means of a hook and loop fastener 126, one side of which is attached to the underside of skin 122 and the other side of which is attached to the upper side of base 124.

Figure 12:
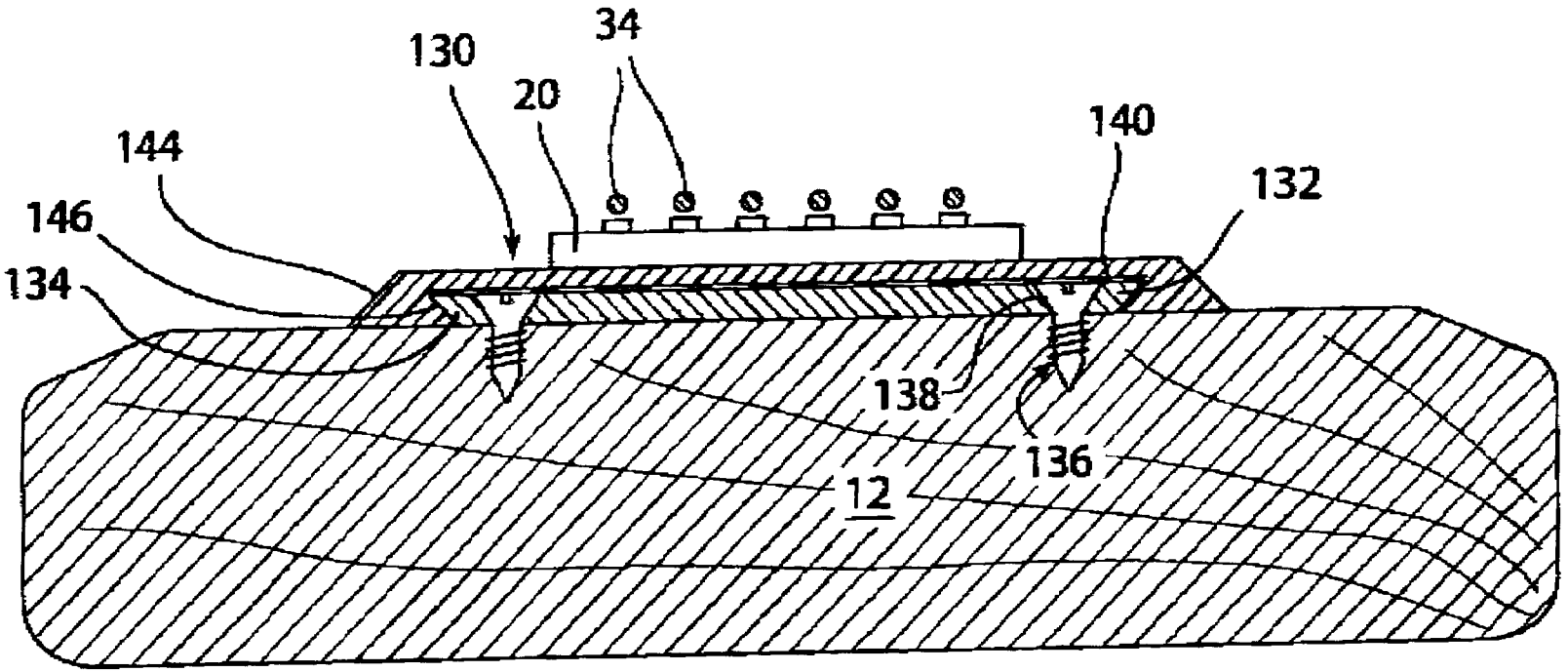
FIG. 12 is a cross-sectional view taken along lines B—B of FIG. 1 showing an eighth embodiment of the present invention.

Still another embodiment of the present invention is shown in FIG. 12. In this embodiment, pickguard 130 includes a base 132 that has an upwardly and outwardly beveled outer edges 134 on opposite sides of the base. The base is attached to the body 12 of the guitar by screws 136 that fit through beveled openings 138 in the base. A decorative sheet 140 fits over the top of the base and covers the screws. A clear acrylic cover 142 fits over the base. The clear acrylic cover has an outer rim 144 with a downwardly and inwardly beveled inside edge 146 that mates with and fits over outer edge 134 of the base. In this embodiment, the skin or decorative sheet either has to be sufficiently flexible that it can be clipped over the top of the base or the base has to be formed with parallel sides 134 on opposite sides, so that the protective layer can be mounted on the base by sliding it longitudinally over the base in a direction parallel to sides 134.

Figure 13:
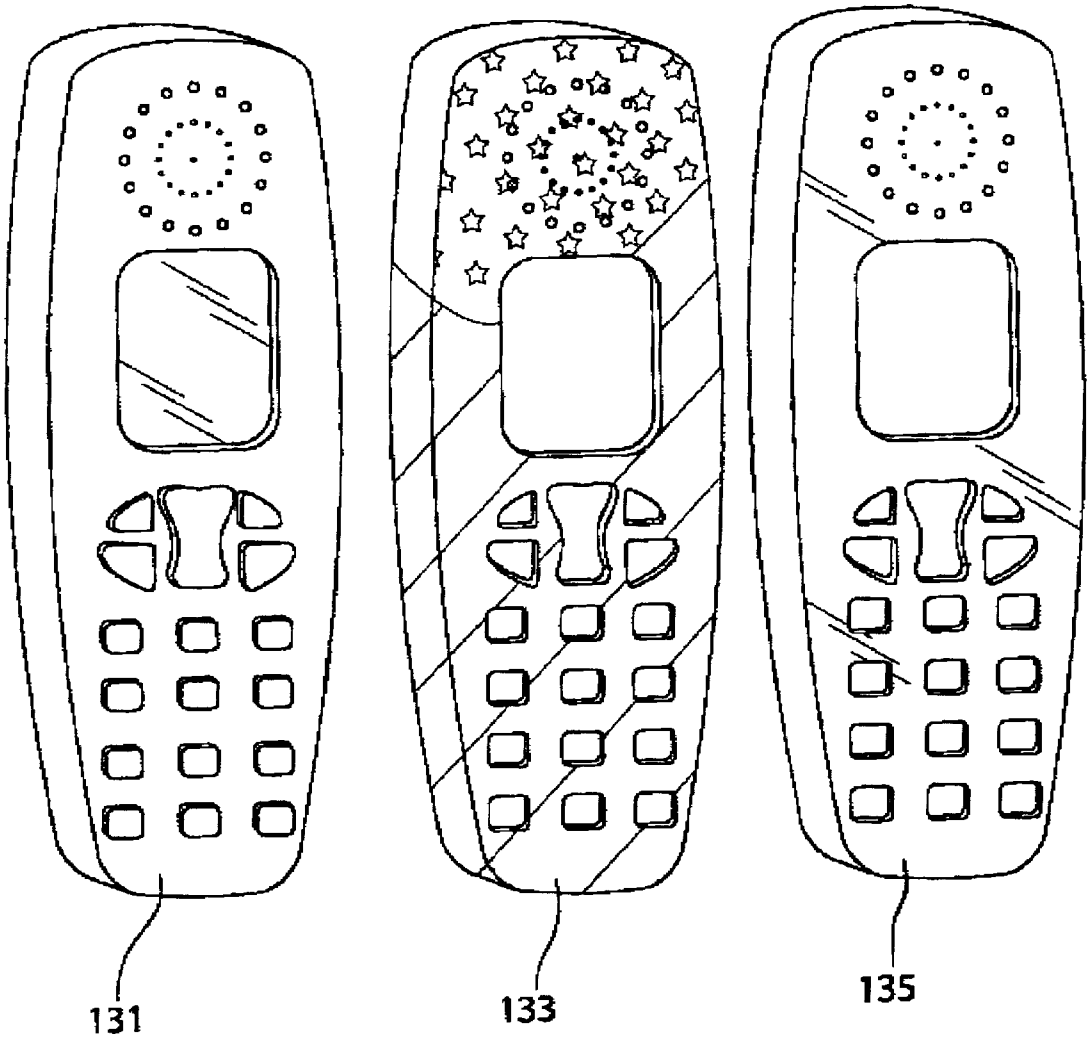
FIG. 13 is decorative applique for use with a cell phone in accordance with an alternate preferred embodiment of the invention.

FIG. 13 shows an alternative preferred embodiment for an interchangeable decorative applique, this time for use with a phone 131 which serves as a base to receive a decorative skin 133. The decorative skin is then interchangeably covered by a plastic face plate 135, preferably comprising a transparent or translucent plastic. The skin 133 and face plate 135 may be secured to the phone in a manner analogous to the embodiments discussed above.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An interchangeable decorative applique comprising, in combination:

a base adapted to be fastened securely to a face of a musical instrument, the base having a mounting surface;

a decorative section having a selected surface appearance, the decorative section being shaped to at least partially cover the base mounting surface;

a clear protective sheet shaped to overlie the decorative section;

fasteners for removably fastening the base to the face of the instrument; and fasteners for removably fastening the protective sheet over the base such that the decorative section is sandwiched between the base and the protective sheet and permitting the protective sheet and underlying decorative sheet to be removed from the instrument without removing the base.

2. An interchangeable decorative applique comprising, in combination:

a base adapted to be mounted on the face of a stringed musical instrument, the base having a desired surface perimetric shape;

a decorative section having a desired outer surface appearance that removably overlies the base, having openings adapted to fit over componentry mounted on the face of the instrument; and releasable attachment means for mounting the decorative section to the base sheet, the attachment means adapted to be releasable to permit the decorative section to be removed and replaced with a different decorative section without removing the componentry or base sheet.

3. The interchangeable decorative applique of claim 2 wherein the releasable attachment means comprises a protective sheet that fits over the decorative section and fastener means for attaching the protective sheet to the base with the decorative section sandwiched therebetween.

4. The interchangeable decorative applique of claim 3 wherein the fastener means comprises protective sheet screws that extend through the protective sheet and extend at least into the base.

5. The interchangeable decorative applique of claim 4 wherein the protective sheet screws extend through the protective sheet and the base and are threaded into the face of the instrument.

6. An interchangeable decorative applique comprising, in combination:

a decorative section having a selected surface appearance, the decorative section being shaped to at least partially cover a mounting surface of a base;

a clear protective sheet shaped to overlie the decorative section;

fasteners for removably fastening the protective sheet over the base such that the decorative section is adapted to be sandwiched between the base and the protective sheet and permitting the protective sheet and underlying decorative sheet to be removed without removing the base; and a base adapted to be fastened securely to a face of a guitar, the base having a mounting surface, and fasteners for removably fastening the base; to the face of the instrument:

wherein the protective sheet and the underlying decorative sheet may be removed from the guitar without removing the base.

* * * * *